United States Patent [19]

Shirakawa

[11] Patent Number: 4,856,476

[45] Date of Patent: Aug. 15, 1989

[54] APPARATUS FOR CONTROLLING THROTTLE VALVE

[75] Inventor: Hiroyuki Shirakawa, Himeji, Japan

[73] Assignee: Mitsubishi Denki Kabushiki Kaisha, Tokyo, Japan

[21] Appl. No.: 221,967

[22] Filed: Jul. 21, 1988

[30] Foreign Application Priority Data

Jul. 27, 1987 [JP] Japan ..... 62-187965

[51] Int. Cl.[4] ..... F02D 11/10

[52] U.S. Cl. ..... 123/342; 123/399; 180/197

[58] Field of Search ..... 123/342, 361, 399, 360; 180/197

[56] References Cited

U.S. PATENT DOCUMENTS 3,270,728 9/1966 Mizuno ..... 123/342 X
4,224,907 9/1980 Lefeuvre et al. ..... 123/360 X
4,392,502 7/1983 Weston ..... 123/342
4,526,060 7/1985 Watanabe ..... 123/339 X

FOREIGN PATENT DOCUMENTS 79050 5/1984 Japan ..... 123/342

*Primary Examiner*—Tony M. Argenbright
*Attorney, Agent, or Firm*—Sughrue, Mion, Zinn, Macpeak and Seas

[57] ABSTRACT

A wire cable 11 extends between an accelerator pedal 19 and a motor pulley 14 controlled depending upon the driving conditions. A block 13 is disposed in contact with the wire cable, and the throttle valve 2 is opened and closed by the movement of the block. Accordingly, an optimum control of the throttle valve can be achieved by driving the block with both the accelerator pedal and the motor, and if the motor system fails the throttle valve can still be operated by the accelerator pedal alone.

6 Claims, 1 Drawing Sheet

APPARATUS FOR CONTROLLING THROTTLE VALVE

BACKGROUND OF THE INVENTION

1. Field of the Invention

This invention relates to an apparatus for controlling a throttle valve in a car engine in which the throttle valve in the engine is operated by an electronic control.

2. Description of the Prior Art

Recently, in order to improve the driving feeling and the roadability of a car, an apparatus for controlling a throttle valve has been developed in which an accelerator pedal is not connected with the throttle valve by means of the conventional simple mechanical means such as a wire cable, but instead an electronic device is disposed between the accelerator pedal and the throttle valve to open and close the throttle valve based on the driving condition of the engine and the traveling condition of the car in addition to the amount of the accelerator pedal depression.

This apparatus for controlling a throttle valve requires a number of driving information sensors including a sensor for detecting the amount of accelerator pedal depression, and also requires an actuator for operating the throttle valve and an electronic control device for treating signals from the respective sensors and controlling the actuator. It thus becomes complicated in comparison with the conventional control using only a wire cable. As a result, reliability problem occur.

Further, a fail-safe mechanism is required to prevent the car from running away due to a malfunction in the electronic control device, and to prevent the throttle valve from being suddenly closed to brake the car during high-speed travel.

In the fail-safe mechanism of a conventional electronic control device of this type, a return spring for returning the throttle valve to a closed position when a malfunction has occurred is mounted on the throttle shaft. However, this conventional fail-safe mechanism has shown problems in that when the actuator fails the car can be prevented from running away, but the travel of the car cannot be maintained. Thus the car cannot be driven to a repair facility, and thee is the possibility that the car will be suddenly braked and bumped from behind during its high-speed travel.

SUMMARY OF THE INVENTION

The present invention solves the above problems by providing an apparatus for controlling a throttle valve including a motor pulley mounted on a motor, which is controlled by the driving information of the car, a wire cable extending between the motor pulley and an accelerator pedal, and a block disposed in contact with the wire cable and driven by inputs to the accelerator pedal and the motor to open and close the throttle valve.

Thus, the block may be driven merely by the accelerator pedal through the wire cable to open and close the throttle valve and maintain vehicle travel even if the motor system fails. This prevents the vehicle from being suddenly braked in the event that the motor system fails during the high-speed travel of the vehicle.

DETAILED DESCRIPTION OF THE PREFERRED EMBODIMENT

Figure 1:
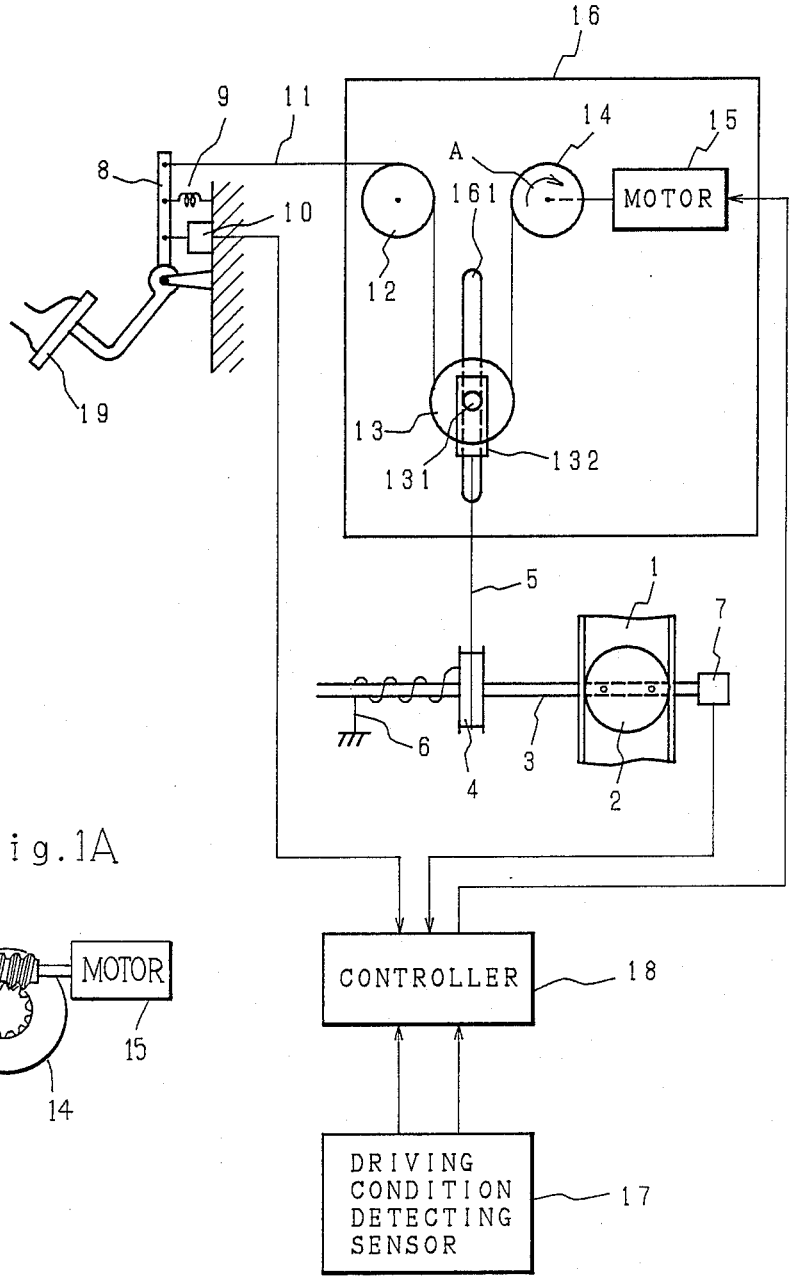
FIG. 1 is a block diagram showing a construction of an apparatus for controlling a throttle valve according to the present invention.

Referring to FIG. 1, reference numeral 1 designates an air inlet pipe of an engine (not shown) and reference numeral 2 designates a throttle valve disposed in the air inlet pipe. The throttle valve is fixedly mounted on a shaft 3 so that the valve may be opened and closed by rotating the shaft. The shaft 3 is provided with a pulley 4 fixedly mounted thereon and a throttle wire 5 extends around a groove of the pulley. In addition a return spring 6 is fixedly mounted on the pulley 4 at one end thereof and surrounds the shaft 3. The return spring is anchored to the engine at its other end so as to provide a torque for biasing the throttle valve 2 towards its closed position and attendantly tensioning the throttle wire 5. The shaft 3 is provided with a sensor 7 for detecting the degree of opening of the throttle valve 2.

Reference numeral 8 designates an accelerator lever connected with an accelerator pedal 19 and provided with a spring 9 for returning the accelerator lever to its original, rest position. A sensor 10 detects the degree of depression of the accelerator pedal 19. One end of a wire cable 11 is fixedly mounted on the accelerator lever 8, and it other end is fixedly mounted on a motor pulley 14 via a pulley 12 and a block 13. The motor pulley 14 is fixedly mounted on a shaft of a motor 15. The pulley 12 and the motor 15 are mounted on a base 16.

The block 13 comprises a central shaft 131 inserted into a groove 161 formed in the base 16 so as to be slidable in the up and down direction. In addition, the central shaft 131 is provided with a hook 132 engaged with the end of the throttle wire 5.

Reference numeral 12 designates a driving condition-detecting sensor comprising various kinds of sensors for detecting, for example, the rotational speed of the engine, the vehicle speed, wheel skid and the like, and outputting them to a controller 18. The controller 18 controls the motor 15 on the basis of the accelerator depression from the pedal sensor 10, the information from the driving condition-detecting sensor 17, and the throttle valve opening from the sensor 7.

In operation, upon depressing the accelerator pedal 19, the wire cable 11 is pulled to the left by the accelerator lever 8. In addition, when the pulley 14 is rotated in the direction of arrow A by the motor 15, the block 13 is raised by the cable 11.

If the movement speed of the wire cable 11 by the accelerator lever 8 is Va, and the movement speed of the wire cable 11 by the motor pulley 14 is Vm, then the movement speed Vs of the throttle wire 5 mounted on the block 13 is $Vs=(Va+Vm)/2$. Since the throttle wire 5 is wound around the pulley 4 with one end thereof fixedly mounted on the pulley, and the pulley 4, the shaft 3 and the throttle valve 2 are internally moved, the throttle valve 2 is operated by both the accelerator lever 8 (the accelerator pedal 19) and the motor 15.

Since the movement speed of the wire cable 11 by the motor pulley 14 is proportional to the rotational speed of the motor 15, various kinds of driving operations, which cannot be realized by merely depressing the accelerator pedal, can be achieved by controlling the revolving speed of the motor 15. For example, when rapid acceleration is desired, the car can be smoothly started by increasing the rotational speed of the motor 15. On the other hand, where there is a possibility of skidding, such as when the car is started on a frozen road surface, the car can be smoothly started by reducing the rotational speed or reversing the direction of revolution of the motor 15 according to circumstances. In addition, it is also possible to select a driving range which provides the best engine efficiency in the travel of the car. These actions are carried out by processing the information from the accelerator sensor 10, the throttle sensor 7 and the driving condition-detecting sensor 17 in the controller 18.

In addition, with this apparatus the throttle valve 2 is operated by both the accelerator lever 8 and the motor 15 as described above, so that even if the motor system fails, the throttle can be controlled to maintain the car travel merely by means of the accelerator pedal 19 by suitably selecting the diameter of the motor pulley 14, whereby a fail-safe operation can be secured.

Figure 1A:
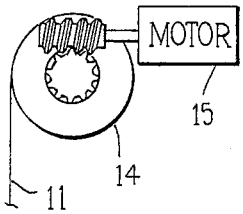
FIG. 1A shows a worm-gear coupling between a drive motor and a pulley.

Although the motor pulley 14 is directly connected with the motor 15 in the preferred embodiment, it may be connected with the motor through a worm-gear as shown in FIG. 1A.

What is claimed is:

1. An apparatus for controlling a throttle valve (2) of a vehicle engine, comprising: a wire cable (11) extending between and connected at opposite ends to an accelerator pedal (19) and a first pulley (14) mounted on a motor (15) controlled by driving information of the vehicle, and a movable block (13) disposed in contact with said wire cable, said block being driven by said wire cable and operably connected to the throttle valve to open and close said throttle valve.

2. An apparatus for controlling a throttle valve as set forth in claim 1, in which said throttle valve is fixedly mounted on a shaft (3) and the throttle valve is opened and closed by rotating said shaft.

3. An apparatus for controlling a throttle valve as set forth in claim 2, in which a second pulley (4) is fixedly mounted on said shaft, and a throttle wire (5) extends between said second pulley and a central shaft (131) of said block.

4. An apparatus for controlling a throttle valve as set forth in claim 1, in which said motor is directly connected with said first pulley.

5. An apparatus for controlling a throttle valve as set forth in claim 1, in which said motor is connected with said first pulley through a worm-gear.

6. An apparatus for controlling a throttle valve as set forth in claim 1, in which said driving information comprises at least one of a rotational speed of the engine, a speed of the vehicle, wheel skid, a degree of accelerator depression and a degree of opening of the throttle valve.

* * * * *